US005804104A

United States Patent [19]

Brauch et al.

[11] Patent Number: 5,804,104

[45] Date of Patent: Sep. 8, 1998

[54] APPARATUS FOR MOVING AN AERATION UNIT

[75] Inventors: Joseph Karl Brauch, Aurora; Charles Lonnie Meurer, Golden; Douglas Lee Meurer, Denver, all of Colo.

[73] Assignee: Meurer Industries, Inc., Golden, Colo.

[21] Appl. No.: 816,870

[22] Filed: Mar. 13, 1997

[51] Int. Cl.[6] ..... B01F 3/04

[52] U.S. Cl. ..... 261/122.1; 210/220; 210/237; 261/124

[58] Field of Search ..... 261/121.1, 122.1, 261/124, DIG. 47, DIG. 70; 210/220, 237, 238

[56] References Cited

U.S. PATENT DOCUMENTS

| | | | |
|---|---|---|---|
| 1,703,967 | 3/1929 | Sperr, Jr. | 261/122.1 |
| 1,717,713 | 6/1929 | Logan | 261/122.1 |
| 2,144,385 | 1/1939 | Nordell | 210/3 |
| 2,328,655 | 9/1943 | Lannert | 261/122 |
| 2,502,187 | 3/1950 | Wahlgren | 261/122 |
| 2,589,882 | 3/1952 | Sinner et al. | 254/136 |
| 2,646,889 | 7/1953 | Dulak | 210/207 |
| 2,650,810 | 9/1953 | Nordell | 261/121 |
| 2,684,330 | 7/1954 | French | 210/8 |
| 2,947,525 | 8/1960 | Klein | 261/122 |
| 2,997,284 | 8/1961 | Nechine | 261/DIG. 47 |
| 3,063,689 | 11/1962 | Coppock | 261/124 |
| 3,083,953 | 4/1963 | Langdon et al. | 261/122 |
| 3,416,176 | 12/1968 | Ravitts | 15/1.7 |
| 3,802,676 | 4/1974 | Thayer | 261/122 |
| 3,846,291 | 11/1974 | Brucker | 210/14 |
| 3,880,965 | 4/1975 | Dudis et al. | 261/122 |
| 3,980,561 | 9/1976 | Miyagi et al. | 210/151 |
| 4,048,267 | 9/1977 | Walker et al. | 261/122.1 |
| 4,071,443 | 1/1978 | Gorski et al. | 210/7 |
| 4,090,966 | 5/1978 | Clendenen | 210/143 |
| 4,193,871 | 3/1980 | White et al. | 210/142 |
| 4,294,696 | 10/1981 | Thayer | 261/122.1 |
| 4,401,576 | 8/1983 | Meurer | 210/803 |
| 4,477,939 | 10/1984 | White et al. | 15/246.5 |
| 4,514,303 | 4/1985 | Moore | 210/519 |
| 4,960,546 | 10/1990 | Tharp | 261/122 |
| 5,013,493 | 5/1991 | Tharp | 261/122 |
| 5,021,153 | 6/1991 | Haws | 210/221.24 |
| 5,087,391 | 2/1992 | Brown | 261/122.1 |
| 5,160,460 | 11/1992 | Goetz et al. | 261/122.1 |
| 5,290,487 | 3/1994 | Scheibinger | 261/122.1 |
| 5,300,232 | 4/1994 | Barrington et al. | 210/742 |

FOREIGN PATENT DOCUMENTS 1329599 1/1970 United Kingdom .

*Primary Examiner*—C. Scott Bushey
*Attorney, Agent, or Firm*—Chester E. Martine, Jr.

[57] ABSTRACT

Force is applied to aeration units from only one side of a basin. Part of such force is transferred from one end of a beam of the aeration unit to the other end of the beam to move both ends of the beam. The beam supports the pipes of the aeration unit. A force transfer module includes one force transfer strand held in a force transfer path between fixed opposite ends of the strand. The force transfer path extends in part along the beam, which is placed in compression. Motion of the one end of the beam resulting from the force is transferred by the single force transfer strand to the opposite end of the beam so that both ends of the beam move relative to the basin under the action of the force. When the aeration unit uses a many-sided frame to support aeration pipes, many modules are used to transfer the force along the pipes to move the entire frame at one time. A method provides a force transfer strand with first and second opposite ends and a length substantially constant under tension. The strand is placed in the force transfer path. The beam is moved by applying force to the one end of the beam. As the one end of the beam moves, the strand transfers some of the force to the opposite end, and places the beam in compression, to move the other end.

20 Claims, 14 Drawing Sheets

FIG. 11

STEP 100: PROVIDE THE FLEXIBLE FORCE TRANSFER STRAND HAVING FIRST AND SECOND OPPOSITE ENDS AND A TOTAL STRAND LENGTH THAT IS SUBSTANTIALLY CONSTANT UNDER TENSION.

STEP 200: PLACE THE FLEXIBLE FORCE TRANSFER STRAND IN THE FORCE TRANSFER PATH WITH THE OPPOSITE ENDS FIXED AGAINST MOVEMENT.

STEP 300: MOVE THE COMPRESSION MEMBER BY APPLYING THE PRIMARY FORCE TO THE PROXIMAL END OF THE COMPRESSION MEMBER.

STEP 400: TRANSFER SOME OF THE PRIMARY FORCE TO THE DISTAL END (AS THE TRANSFERRED FORCE $F_T$), PLACE THE COMPRESSION MEMBER IN COMPRESSION, AND USE THE FORCE $F_{L\text{-}U}$ TO MOVE THE DISTAL END.

APPARATUS FOR MOVING AN AERATION UNIT

BACKGROUND OF THE INVENTION

1. Field of the Invention

This invention relates to moving a structural member of an aeration unit, and more particularly, to applying a primary force to one end of a beam of an aeration unit of a water treatment apparatus and using a tension member extending in a force transfer path to transfer some of the primary force to move the other end of the beam.

2. Discussion of Prior Aeration Unit Movers

Basins are used to purify liquids in plants such as water and waste water treatment plants by removing impurities, thereby making the water suitable for use, reuse, or for further treatment, such as tertiary treatment. Aeration units are used in such basins of the plants to provide gas for biological treatment, or for mixing the liquid. The aeration units are usually permanently installed in the basin. In many permanent installations, the pipes of the units are secured to the bottom of the basin to resist the inherent buoyancy of the pipes, which are filled with the gas. Thus, removal of the pipes for maintenance is difficult, if not impossible, without interrupting the aeration process.

Some have suggested the use of pipes with rotary joints, or swing arms, to facilitate removal of the pipes from the basin for maintenance. However, the design of the joints often limits the size or configuration of the aeration unit. In other aeration units with removable pipes, the individual pipes and valves are difficult to handle. Where supports other than the bottom of the basin have been provided for the aeration units, hoists or cranes have been used to lift the supports, but also interfere with the aeration operations. Further, the many different types of aeration units do not lend themselves to a universal, or all-purpose, way of retrieving the units from, and replacing the units in, a basin for maintenance. Thus, there is a need for a way of retrieving from such basins all types of aeration units, including units that have already been installed, without interfering with ongoing aeration operations. Also, since plant operators are generally reluctant to increase investment just to maintain the existing aeration units, any new equipment for removal and replacement of the aeration units must be as simple and cost-effective as possible. The term "retrieval" as used herein means the removal of any type of aeration unit from such basin, e.g., for maintenance, and the movement of any such type of aeration unit into such basin, e.g., following maintenance.

Other factors relating to maintenance of such aeration units include that, for efficient operation, controls for equipment that performs such retrieval, and preferably such equipment itself, should be centralized. Centralization, for example, means that the controls and equipment should be one side of the basin, for ease of access by the operator.

An example of an attempt to retrieve one aerator pipe at a time from a basin is shown in Nordell U.S. Pat. No. 2,650,810. There, dual lengths of a single, main endless band extend parallel to each other along a coping at an edge of a basin. The coping extends above the pipe. At each of many spaced locations along the main band, separate cables are attached to the main band and extend around fixed pulleys secured to the coping. Each separate cable then extends down into the basin and is attached directly to a different part of the aeration pipe. As the main band is moved along the coping, one end of each separate cable moves with the main band, and the attached part of the cable moves up or down in the basin. With the attached part of each such cable attached to the aeration pipe, the cables move the aeration pipe up in the basin. This type of pipe moving system is provided for each aeration pipe. Further, it requires the two lengths of the main band to extend along the coping of the basin so that the separate cables may be attached to the main band and extend down into the basin so as to directly apply force to the pipe at locations spaced across the basin. Also, if an aeration pipe is centered in the basin, i.e. toward the center from the coping, a separate truss has to be mounted across the top of the basin to support the fixed pulleys which are normally secured to the coping when the pipe is directly below the coping. The extension of the main band across the coping of the basin, and such separate truss, may interfere with operations other than aeration.

In another method of moving a device for aerating liquid in a basin, shown in U.S. Pat. No. 5,290,487 a fixed rail is mounted in the basin for guiding sliders that carry pipe holders. The holders surround the pipe to avoid stressing the pipe. A cable pulls the sliders on the rail to move the pipe into and out of the basin. However, opposite ends of the cable exit the basin at opposite sides of the basin, such that there is no central point at which the cable is moved. Further, the pipe can only be removed in this manner if it is flexible.

In another device for aerating liquid in a basin, shown in U.S. Pat. No. 2,328,655, pipes supply air to manifolds in the basin. The pipes are provided with elbows having two sections which rotate to permit the pipes to swing and move out of the basin, carrying the manifolds out of the basin. However, the swinging method of removing the pipes from the basin limits the length of the pipes to permit the pipes to clear a stantion of the basin.

In another version of a device for aerating liquid in a basin as shown in U.S. Pat. No. 1,195,067, no provision is made for removing a rotating pipe or a reciprocating pipe from the basin, other than manually lifting the pipes from the basin.

Sinner et al. U.S. Pat. No. 2,589,882 does not describe a system for moving an aeration unit. Rather, a casket lowering system uses two cables to lower the casket. The Sinner et al. system includes a fixed carriage that extends across the length and width of an open grave to support pulleys. A reel on the carriage at one end of the grave pays out two separate pairs of cables. One cable extends from the reel, around pulleys on the fixed carriage, and under one end of the casket. The other cable extends from the reel, around other pulleys on the carriage, and under the other end of the casket. As the reel is rotated, the cables pay out uniformly so that both ends of the casket are lowered at the same time. However, in addition to not being designed for moving an aeration unit, the Sinner et al. system requires that the fixed carriage extend all the way across the open grave to position both of the cables under the casket. Further, the carriage is not moved for moving the casket. Rather, the carriage only supports the reel and the pulleys, and both cables pass under the casket. Thus, Sinner et al. do not provide for one cable to move one end of a beam of a frame, and do not transfer force from one end of a movable frame to a second cable to lift an opposite end of the frame.

SUMMARY OF THE PRESENT INVENTION

Applicants' studies of these problems indicates that the requirement for centralized controls and equipment for retrieving aeration units from basins is not met by the prior art equipment. The aeration pipes permanently attached to the basin have the obvious disadvantages noted above. The use by Nordell of one lifting system for only one aeration pipe appears to be inefficient, for example.

Having studied such equipment, it appears to Applicants that there is a way of applying force to such aeration units from only one side of a basin, and transferring part of such force from one end of a beam of the aeration unit to the other end of the beam to move both ends of the aeration unit. The beam supports the pipes of the aeration unit, and the pipes are balanced relative to the axis of the beam. In this solution to the problems discussed above, a primary force is applied to one end of the beam. A single force transfer strand is held in a force transfer path between fixed opposite ends of the strand. The force transfer path extends in part along the beam, which is placed in compression. Motion of the one end of the beam resulting from the primary force is transferred by the single force transfer strand to the opposite end of the beam so that both ends of the beam move relative to the basin under the action of the drive.

In another aspect of this solution to the problems discussed above, more than one beam may be used to support the pipes of the aeration unit, or the pipes themselves may be structural members and carry the gas. One example provides the beams or the pipes in a U-shape, referred to as a U-shaped frame. The drive applies the primary force to the middle of a center (or base) beam or pipe of the U-shaped frame. The opposite ends of the center beam are moved by the primary force of the drive, and each such opposite end moves a first end of each of two other beams (or legs), or pipes, of the U-shaped frame. On each such other leg, a force transfer strand is held in a force transfer path. Opposite ends of the strand are held fixed and spaced from the respective leg. The motion of the first ends of the other legs of the frame (resulting from the primary force) is transferred by each such force transfer strand to the opposite end of the respective leg, and each such other leg is placed in compression, so that both ends of each such leg move relative to the basin under the action of the drive. In situations, for example, in which the center beam is not balanced, a drive may be located at each of the ends of the center beam to apply a separate primary force directly to the respective end of the center beam.

In still another aspect of this solution to the problems discussed above, the plurality of beams, or the plurality of structural, gas carrying pipes, may be connected in a triangular shape having three sides, or in a quadrilateral shape having four sides. In either case, the shape is referred to as a frame, the sides of which define a closed perimeter. For aeration units in a circular basin, for example, the quadrilateral shape may be trapezoidal. For aeration units in a square or rectangular basin, for example, the quadrilateral shape may be square or rectangular. A corner of the triangular shape, or one or more corners of the quadrilateral shape, may be defined, and the drive connected to such corner to apply the primary force to the corner. The primary force applied to the corner moves each adjacent beam or pipe that forms the corner. A force transfer strand is provided along each such adjacent beam or pipe in the same manner as the one force transfer strand of the one beam described above. Opposite ends of each strand are held fixed. Part of the force that moves the corner of the frame is transferred by the two strands along the respective adjacent beam or pipe, placing the beam or pipe in compression, and urging the opposite ends of the adjacent beams or pipes in the same direction as the drive moves the corner, so that both beams or pipes move with the corner relative to the basin.

For the quadrilateral shape having four sides, two adjacent first corners may be defined, and a drive connected to each first corner to apply the primary force to each such first corner. The primary force applied to each first corner moves the beam or pipe common to the two first corners, and moves each other beam or pipe that forms the respective first corner. A force transfer strand is provided along each such other adjacent beam or pipe in the same manner as the one force transfer strand of the one beam described above. Opposite ends of each strand are held fixed. Part of the force that moves the respective first corner of the frame is transferred by the two strands along the respective adjacent other beam or pipe to the two opposite (or second) corners of the frame. The transferred force places each other beam or pipe in compression, and urges the opposite ends of the adjacent other beams or pipes in the same direction as the drives move the first corners, so that the second corners, and both other beams or pipes, move with the two first corners relative to the basin. The two first corners (to which the drives are connected) are the ones to which the operator has easy access, whereas the second two corners moved via the force transfer strand may be in the middle of the basin, for example.

In another aspect of this solution to the problems discussed above, for the quadrilateral type of frame, three force transfer strands are provided. Two extend from the same corner along adjacent beams or pipes which define the corner, as described above. The third spans the diagonal from the one corner to the diagonally opposite corner. The two strands are along the adjacent beams or pipes of the frame. If a diagonal structural member is provided to be placed in compression, the third extends in the force transfer path along that compression member. Otherwise the four beams or pipes are placed in compression and no separate compression member is needed. Motion of the corner of the frame under the action of a drive at the corner is transferred by the three strands to the opposite corners, placing the beams or the pipes in compression, to move the opposite corners in the same direction as the drive moves the one corner, so that the entire frame moves relative to the basin.

A method which solves these problems may be provided for moving both ends of a beam, or such aeration pipe, in a given direction. The method involves a step of providing a force transfer strand with first and second opposite ends and a length that is substantially constant under tension. The flexible force transfer strand is placed in a force transfer path with the opposite ends fixed against movement. In use with the beam, the path extends from above one of the ends of the beam and around the one end and along the beam to the other end of the beam and around the other end of the beam and to a fixed point below the other of the ends of the beam. The beam is moved by applying force to the other of the ends of the beam in the given direction. The force is sufficient to move the other end of the beam. As the other end of the beam moves in the given direction, the tension strand transfers some of the force in the given direction to the one end, and places the beam in compression, to move the one end in the given direction.

With these features of the present invention in mind, it may be understood that the present invention contemplates providing a force transfer strand extending in a force transfer path relative to an aeration unit which is to be moved by a drive at one side of the unit.

The present invention also contemplates providing the force transfer strand in the form of a wire rope which extends around pulleys mounted on the unit, with the ends of the wire rope fixed to structure of the basin.

The present invention further contemplates providing the length of wire rope with a length that is effectively constant under tension, using pulleys on the unit to guide the wire rope in the path, and placing a beam or pipe of the unit in compression.

The present invention further contemplates having one length of such wire rope extend along a pipe of the aeration unit, and applying force to only one end of the pipe, while using the wire rope to transfer such force to the other end of the pipe to place the pipe in compression and move the other end of the pipe to assure even movement of the pipe.

The present invention further contemplates a method of moving a gas pipe of an aeration unit from a basin. A first step provides a force transfer strand with first and second opposite ends and a length that is substantially constant under tension. The strand is placed in a force transfer path with the opposite ends fixed against movement. Force is applied to one of the ends of the pipe to retrieve the pipe from the basin. The force is sufficient to move the one end of the pipe so that as the one end of the pipe moves up, the strand transfers some of the force to the other end of the pipe, places the pipe in compression, and also moves the other end up.

BRIEF DESCRIPTION OF THE DRAWINGS

Other features and advantages of the present invention will be apparent from an examination of the following detailed descriptions, which include the attached drawings in which:

FIG. 11 is a flow chart showing the steps of the method of the present invention for moving an aeration unit in a basin;

DETAILED DESCRIPTION OF THE PREFERRED EMBODIMENTS

Aeration Basin 20

Figure 1:
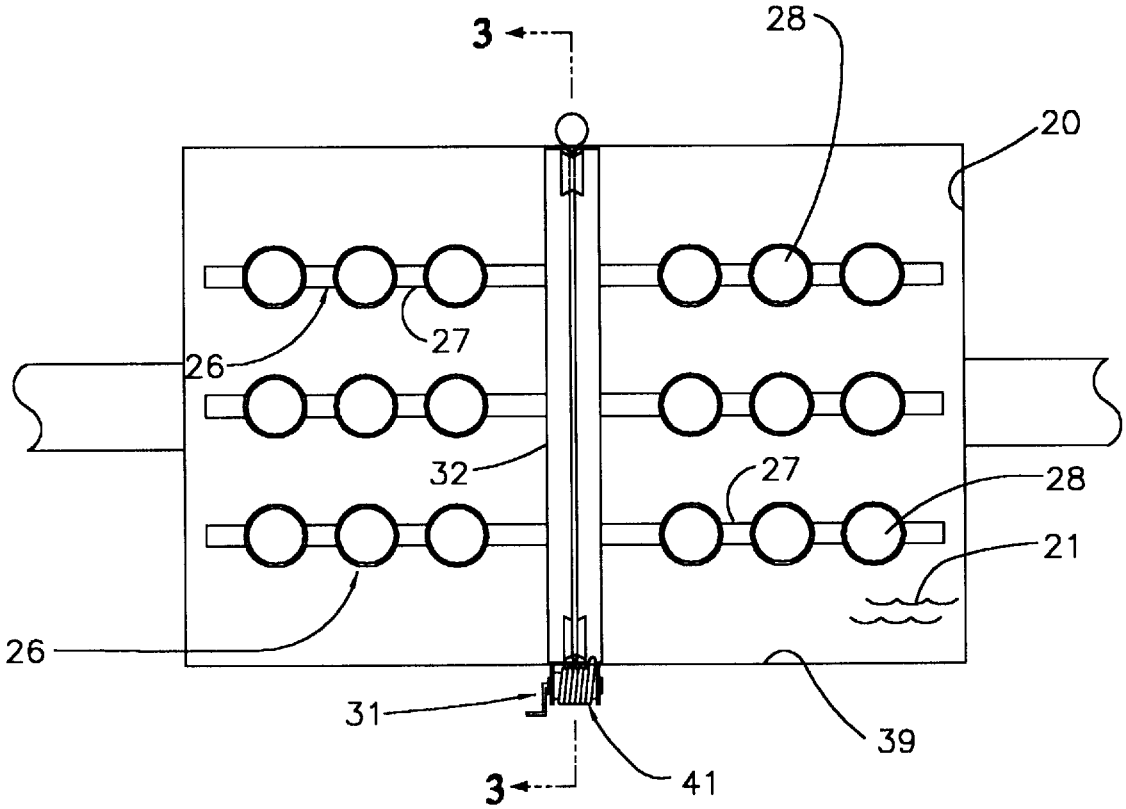
FIG. 1 is a plan view of one aeration unit which covers the whole area of a liquid treatment basin, where the unit includes two aeration pipes which were secured to the bottom of the basin, which pipes according to present invention have been removed from the bottom and secured to a structural pipe or beam of an aeration unit retrieval device to permit selective retrieval for maintenance.
Figure 2:
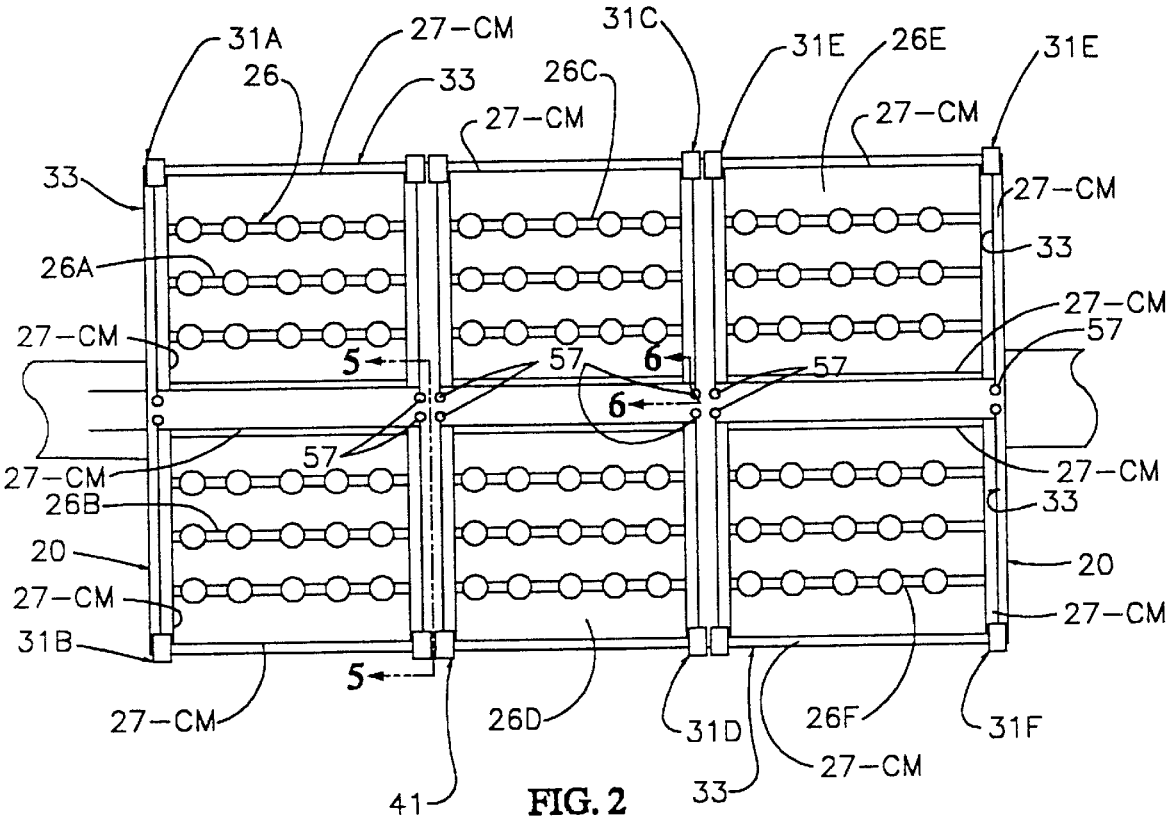
FIG. 2 is a plan view of multiple aeration units, each of which covers only a portion of the area of the liquid treatment basin, wherein according to present invention pipes of each unit have been structurally designed to support other pipes and carry gas, and wherein each unit may be separately retrieved from the basin without interfering with the operation of the other units.

Referring to FIGS. 1 and 2, a basin 20 is shown for treating liquid 21, such as by aerating and mixing the liquid 21 to assist in making the water suitable for use, reuse, or for further treatment. The liquid 21 may be water or waste water, for example. The basin 20 has vertical outer walls 22, an open top 23 and a bottom 24. The present invention may be used with any shaped basin 20, such as rectangular (shown), or circular or square (not shown).

Aeration Units 26

Aerating of the basin 20 is performed by aeration units 26 which include pipes 27 to supply gas, such as air, to diffusers 28. As an example, the diffusers 28 are shown as hollow disk-shaped outlets which discharge small bubbles (not shown) of the gas into the liquid 21. In the past, the pipes 27 have been secured to the bottom 24 of the basin 20 against the buoyant forces resulting from the gas which fills the hollow pipes 27. One aeration unit 26 is shown in FIG. 1 for aerating the entire area of the basin 20 between the walls 22.

Retrieval Apparatus 31

A retrieval apparatus 31 of the present invention may be used with one aeration unit 26 which aerates the entire area of the basin 20 between the walls 22; or with an aeration unit 26 which is divided into many separate sections, e.g., 26A, 26B, etc. as shown in FIG. 2. When the aeration unit 26 is divided into many separate sections 26A, etc., the retrieval apparatus 31 has one section 31A, 32B, etc. for each such section 26A, 26B, etc. of the aeration unit 26. Each section 26A of the aeration unit 26, and each section 31A of the respective retrieval apparatus 31, are separate from the other sections 26B of the aeration unit 26, and from the respective other sections 31B of the retrieval apparatus 31. Thus, one section 26A of the aeration unit 26 may be retrieved and repaired while all of the other sections 26B, etc. of the aeration unit 26 are functional. The retrieval apparatus 31A of the present invention may be used to remove one such section 26A from the basin 20, as by lifting the section 26A upwardly out of the liquid 21 so that it is easily accessible for repair. The same section 31A of the retrieval apparatus 31 may be used to forcefully move the section 26A back into the basin 20 against such buoyant forces for aeration operation (see FIG. 5).

When a basin 20 already has an aeration unit 26 installed in it, but the unit 26 cannot be adequately retrieved for maintenance, the aeration unit 26 is detached from the bottom 24 and is secured to a structural beam 32 (FIG. 1), or a frame 33 (FIG. 2), of the retrieval apparatus 31. When a basin 20 does not yet have an aeration unit 26 installed in it, but it is desired to have an aeration unit 26 be adequately retrievable for maintenance, the aeration unit 26 is designed integrally with selected parts of the retrieval apparatus 31, e.g. by designing the pipes 27 for both structural support and carrying the gas.

First Embodiment 31-1 of Retrieval Apparatus 31

Figure 3:
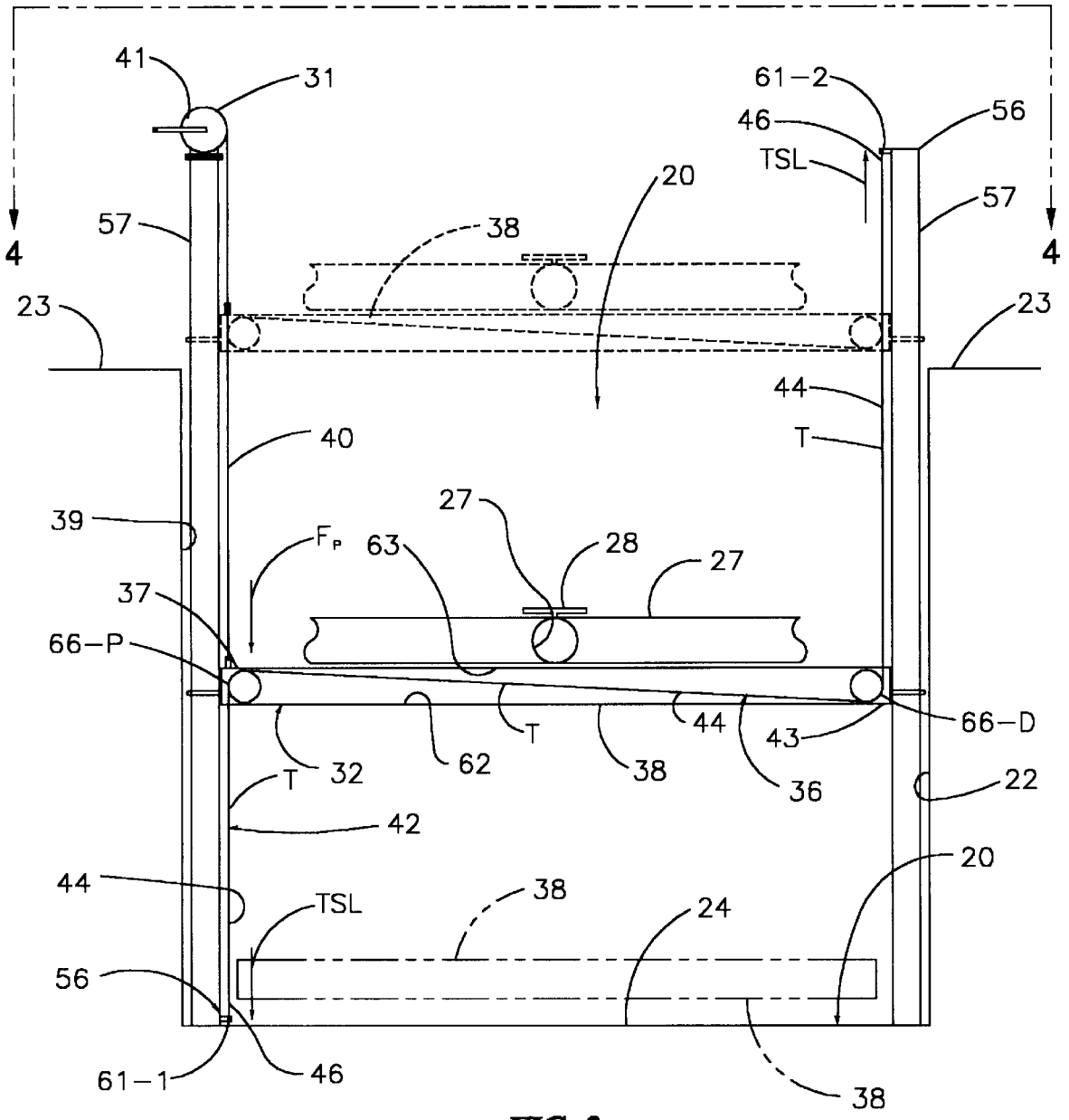
FIG. 3 is a vertical cross section taken along line 3—3 in FIG. 1 showing a left end of the structural pipe or beam of the aeration unit being moved up out of the basin by a primary force drive, and a force transfer device transferring some of the primary force to the right end of the beam to place the beam in compression and move the right end up out of the basin to retrieve the aeration unit for maintenance.
Figure 5:
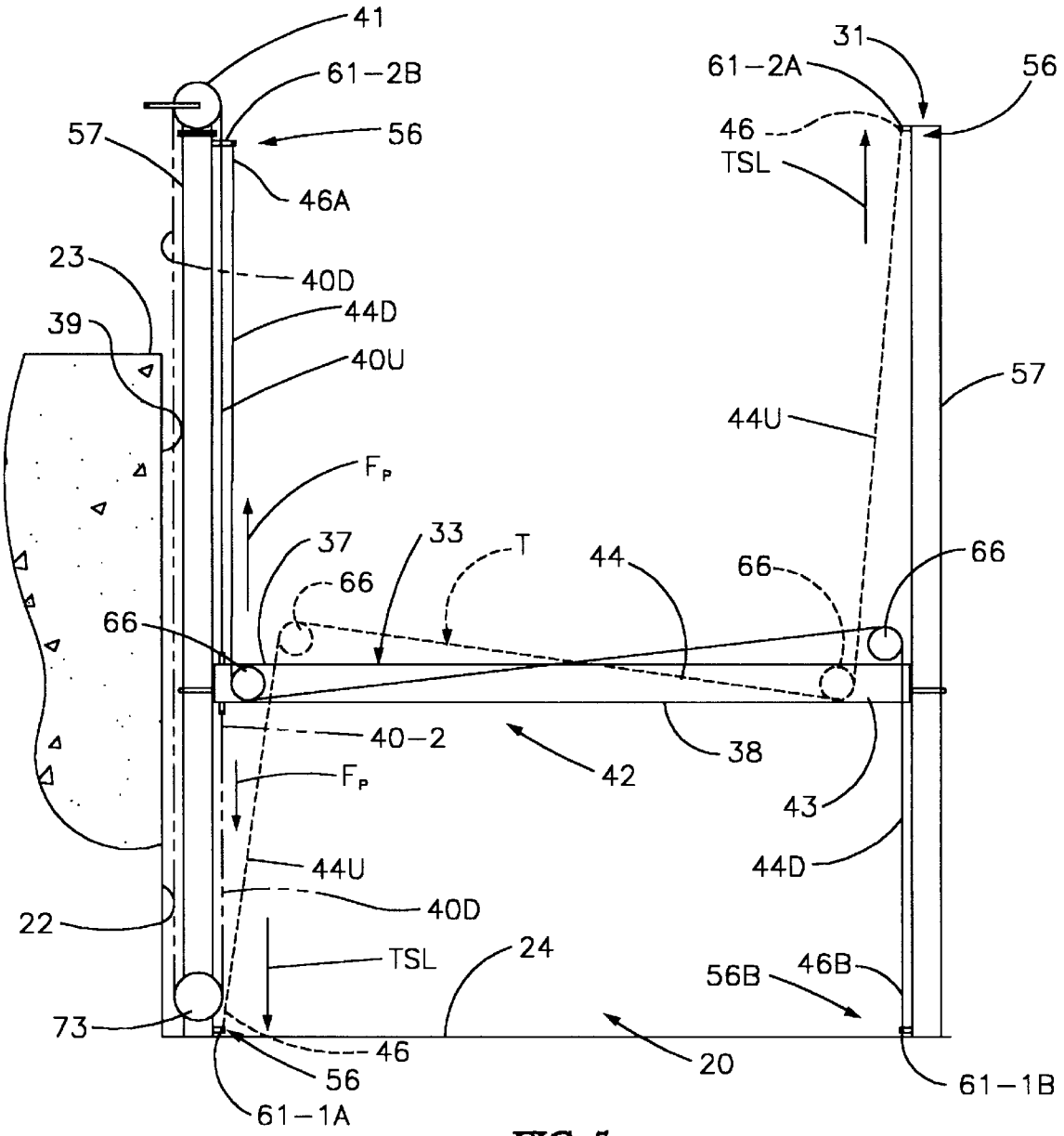
FIG. 5 is a vertical cross section taken along line 5—5 in FIG. 2 showing a left end of a structural pipe of the aeration unit being moved up out of the basin by a primary force drive at the wall of the basin, and the force transfer device transferring some of the primary force to the right end of the pipe, wherein posts hold opposite ends of the force transfer strand of the force transfer device and the structural pipe carries pulleys for guiding the force transfer strand.
Figure 8:
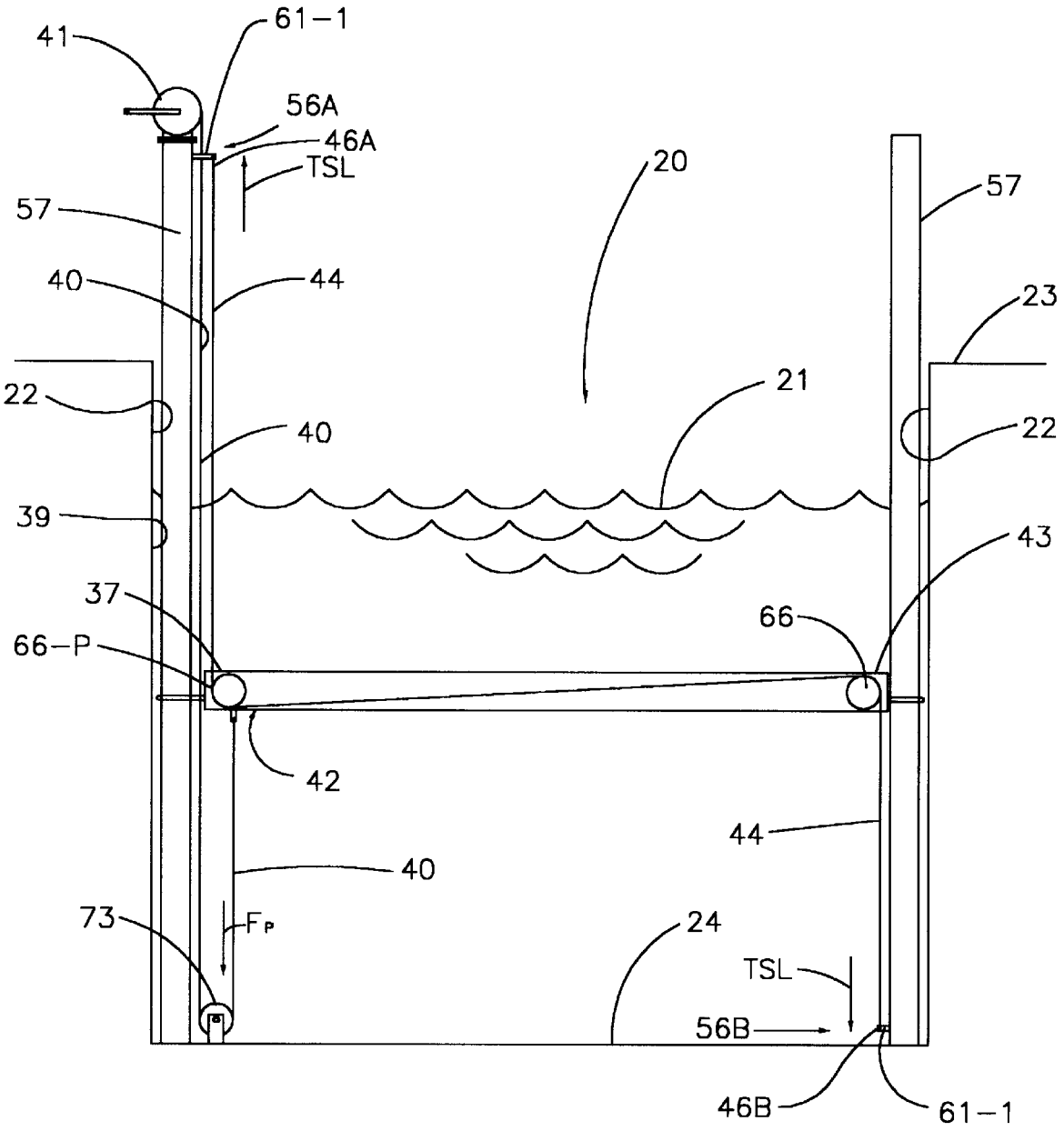
FIG. 8 is a vertical cross sectional view similar to FIG. 3, showing a dual direction (up and down) primary drive used to move an aeration unit out of the basin for maintenance and into the basin after maintenance.
Figure 9A:
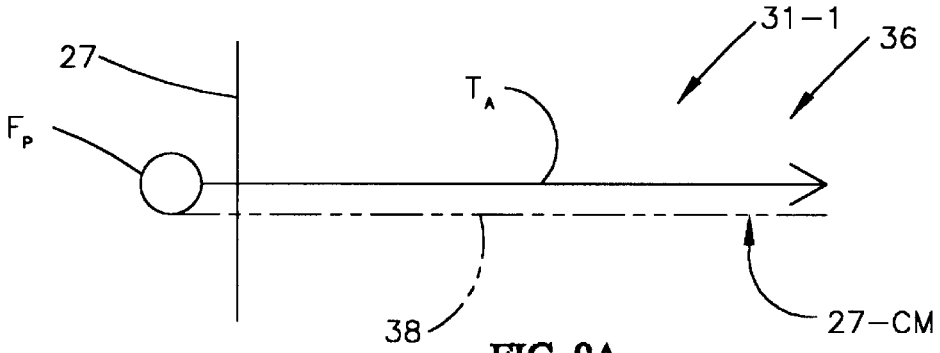
FIGS. 9A through 9G are a series of schematic views showing different embodiments of the present invention, wherein one or two primary forces $F_P$ is/are applied to a structural pipe (shown by a small circle) of an aeration unit, and either one, two or three force transfer strands (shown by the arrows) of the force transfer device transfer part of the primary force(s) $F_p$ to the opposite end (at the arrowhead) of the structural pipe.
Figure 9B:
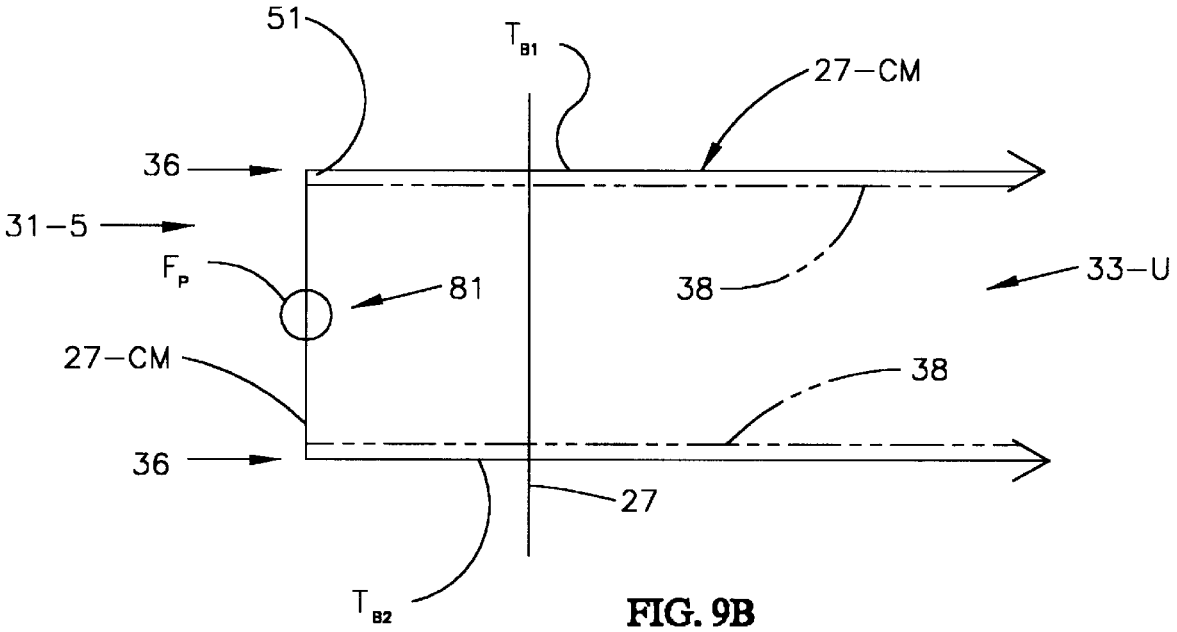
Figure 12A:
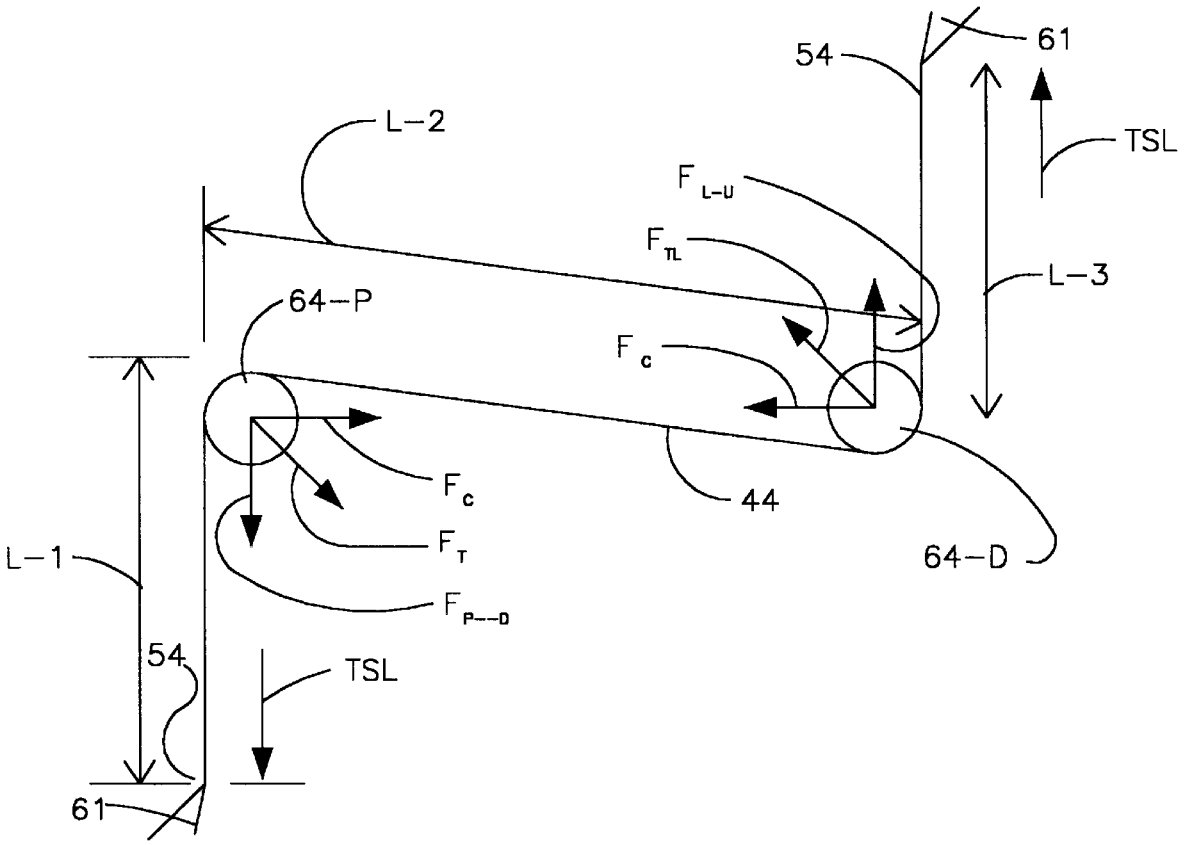
FIG. 12A is a schematic diagram of the force transferred by the force transfer strand shown in FIG. 3, and by one of the force transfer strands shown in FIG. 5.
Figure 12B:
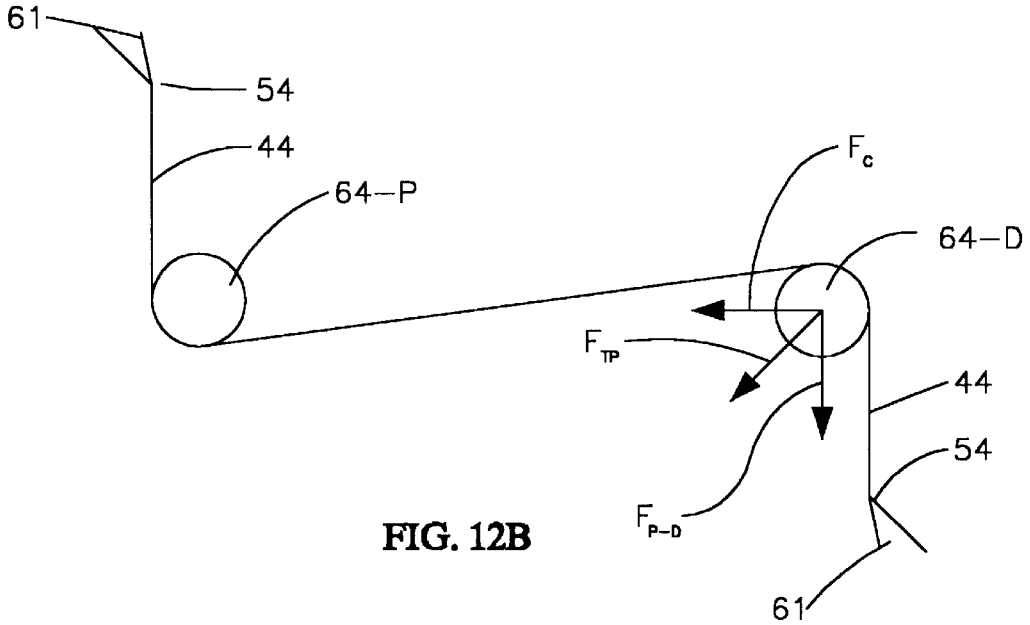
FIG. 12B is a schematic diagram of the force transferred by the force transfer strand shown in FIG. 8, and by one of the force transfer strands shown in FIG. 5.

A basic module 36 of a first embodiment 31-1 of the retrieval apparatus 31 is shown in FIGS. 1 and 3. The module 36 is used alone as described with respect to FIG. 9A, or in pairs as shown in FIGS. 9B through 9F, and in a group (e.g., with three) modules 36 as shown in FIG. 9G. In each module 36, a primary force $F_P$ is applied to a proximal end 37 of a compression member 38. The compression member 38 may be the beam 32 or a portion of the frame 33 or one of the pipe 27 of such aeration unit 26 (or of a section 26A of such unit 26). The primary force $F_P$ is applied from one side 39 (FIG. 1) of the basin 20. The location of the primary force $F_P$ is schematically shown in FIGS. 9A through 9G by a small circle adjacent to the "$F_P$" reference number, and in FIGS. 3, 5 and 8 by a force applicator 40 driven by a drive 41. The compression member 38 is schematically shown in FIGS. 9A through 9G by the dash-dot-dot-dash lines. In each module 36, the primary force $F_P$ moves the end 37 of the compression member 38 in the desired direction (e.g., up or down relative to the basin 20). In response to the movement of the end 37 of the compression member 38, in each module 36 a force transfer device 42 places the compression member 38 in compression between the end 37 and a distal end 43 and thereby transfers some of the primary force $F_P$ to the distal end 43 as a force $F_T$. The force transfer device 42 is shown in FIGS. 3, 5 and 8 as including a single force transfer strand 44 held in a force transfer path illustrated by arrows "T" in FIGS. 9A through 9G. The force transfer path T extends between fixed opposite ends 46 of the strand 44, and extends in part along the compression member 38. The force transferred to the distal end 43 of the compression member 38 is shown in FIG. 12A as a lifting or retrieval force $F_{TL}$ to describe the force in FIG. 3; and in FIG. 12B as a returning or pull-down force $F_{TP}$ to describe the force in FIG. 8. A vertical component of these respective forces $F_{TL}$ and $T_{TP}$ is shown as a lift-up force $F_{L-U}$ (FIG. 12A) and a pull-down force $F_{P-D}$ (FIG. 12B). In FIGS. 3 and 5, the force $F_{L-U}$ lifts the distal end 43 as the force applicator 40 lifts the proximal end 37, so the ends 37 and 43 are moved at the same time. In FIGS. 5 and 8, the force $F_{L-D}$ lowers the distal end 43 as the force applicator 40 lowers the proximal end 37, so the ends 37 and 43 are moved at the same time.

Figure 4:
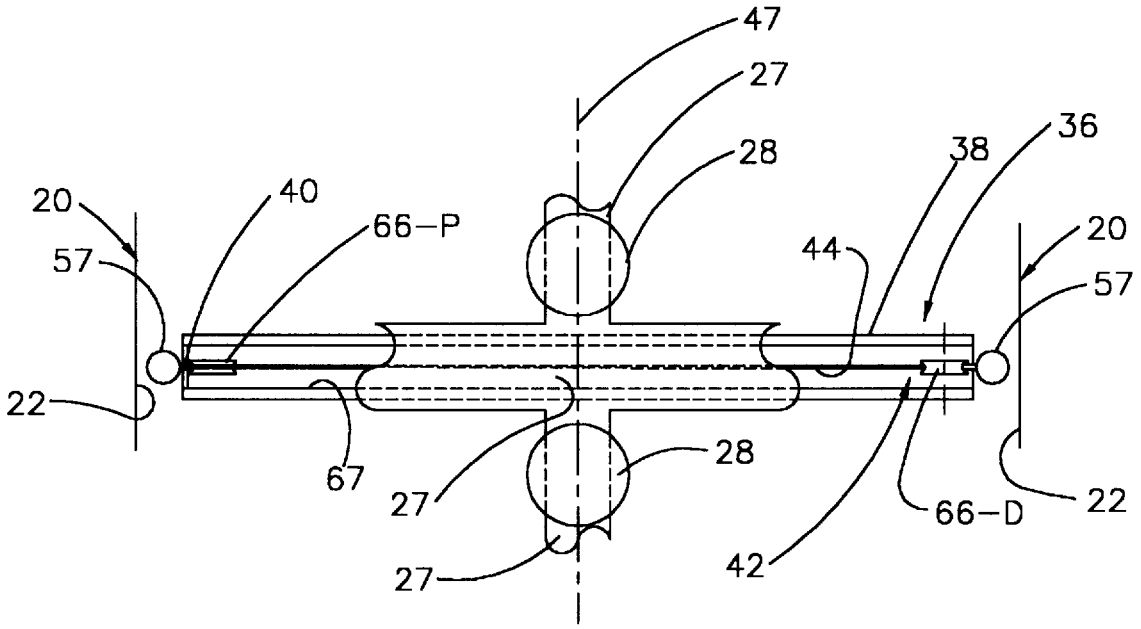
FIG. 4 is an enlarged plan view of a portion of the retrieval device shown in FIG. 1, showing a wire rope for applying the primary force directly to the structural beam, and a force transfer strand of the force transfer device extending around pulleys on the beam.

In FIG. 3, the compression member 38 is in the form of the beam 32 secured and carrying the pipes 27 of the aeration unit 26, such that these pipes 27 need not have structural features. The compression member 38 is balanced relative a longitudinal axis 47 (FIG. 4) of the compression member 38.

Second Embodiment 31-2 of Retrieval Apparatus 31

The basic module 36 of the first embodiment 31-1 of the retrieval apparatus 31 shown in FIGS. 1 and 3 is used with a second module 36 as shown in FIGS. 9B through 9F. Referring to embodiment 31-2 shown in FIG. 9C as an example, many of the modules 36 are used to provide more than one compression member 38 to support the pipes 27 of the aeration unit 26. For clarity of illustration, only one pipe 27 is shown in FIGS. 9A–9G, and such pipe 27 is represented by a single line. The pipes 27 themselves may be hollow, structural compression members 38 and carry the gas, in which case the pipes 27 are referred to as the pipes 27-CM to denote characteristics of the compression members 38.

Figure 9C:
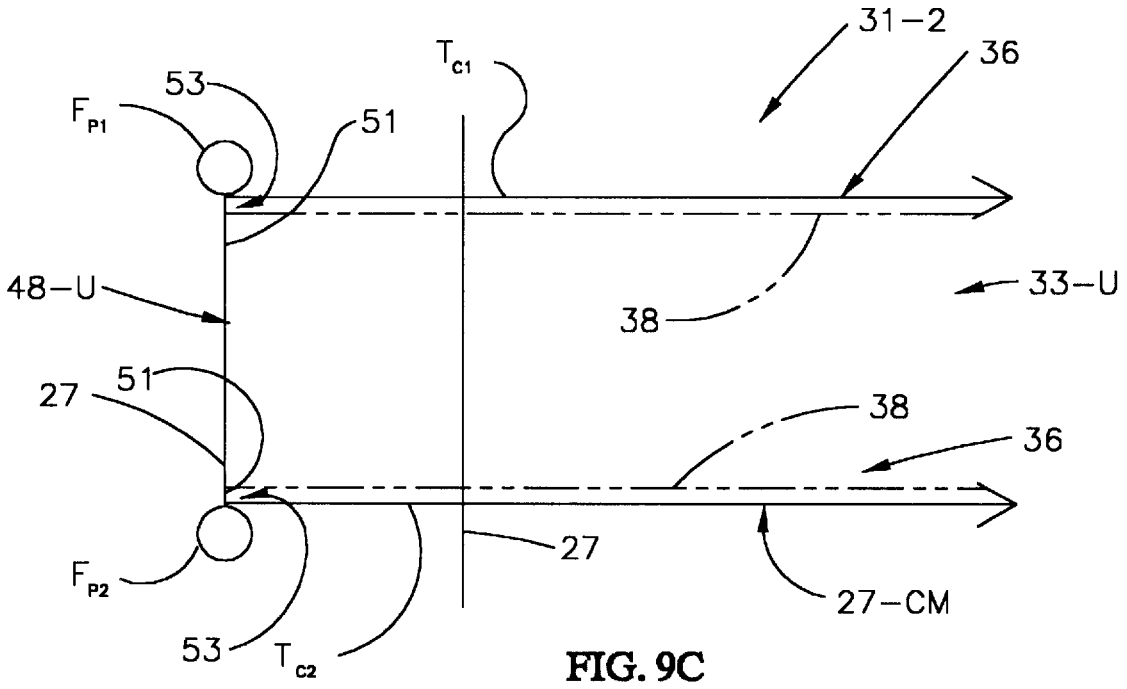

The example of FIG. 9C provides a U-shaped frame 48-U, with the compression members 38 (or the pipes 27-CM) parallel and a center pipe 27 between the two compression members 38 (or the pipes 27-CM). The force applicator 41 applies the primary force $F_P$ to each end 51 of the center pipe 27. Since the compression members 38 are connected to the respective ends 51 of the center pipe 27, the primary force $F_P$ is applied directly to each proximal end 37 of the compression members 38 that are connected to the center pipe 27, and are denoted $F_{P1}$ and $F_{P2}$ in FIG. 9C.

Each basic module 36 includes the force transfer strand 44 held in the force transfer path T. In the manner described above for the module 36 in embodiment 31-1, each module 36 of the second embodiment 31-2 shown in FIG. 9C is effective to either lift up or pull down the respective compression members 38 (or pipes 27-CM) according to the direction (up or down) in which the primary force $F_{P1}$ or $F_{P2}$ is applied to the respective proximal ends 37.

Frames 48

Figure 9D:
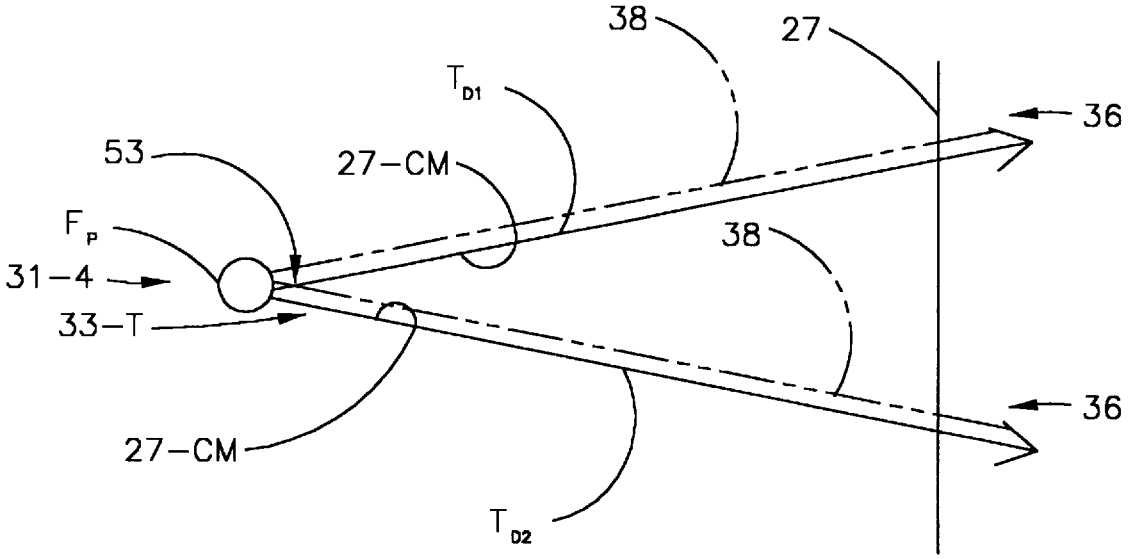
Figure 9E:
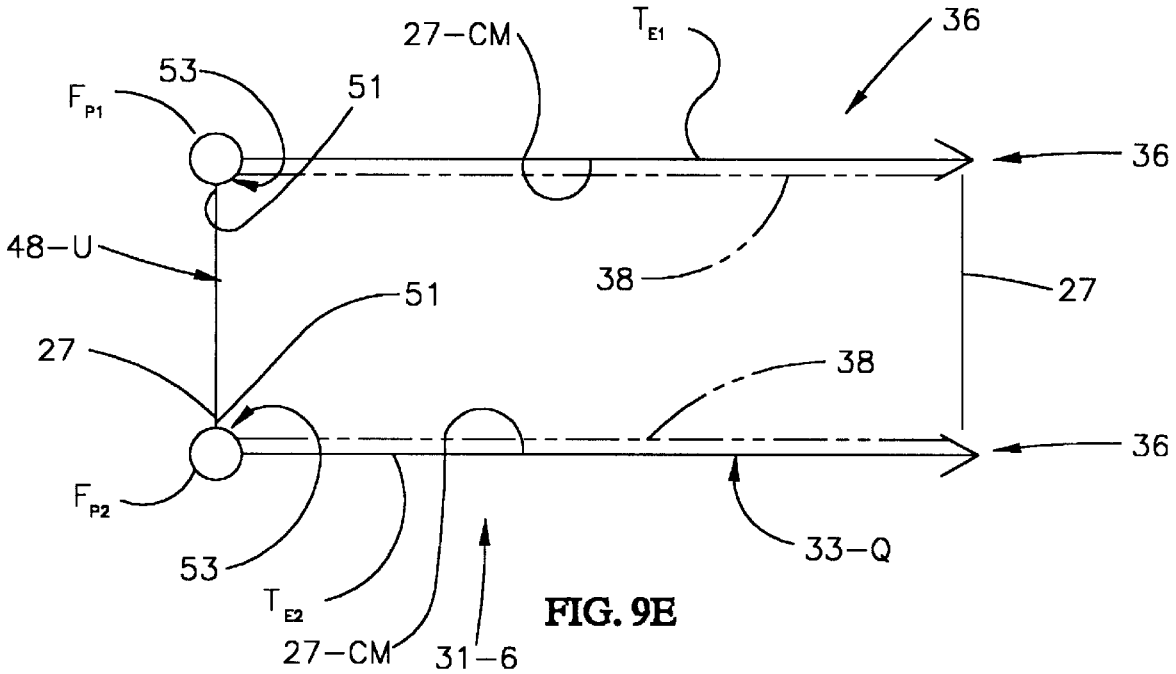
Figure 9F:
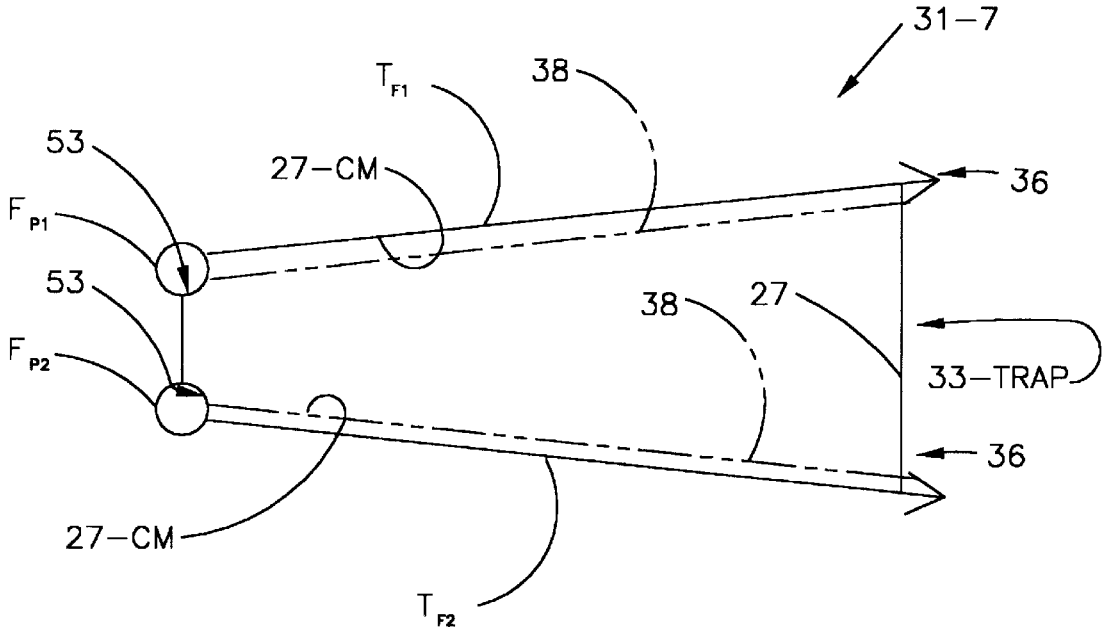
Figure 9G:
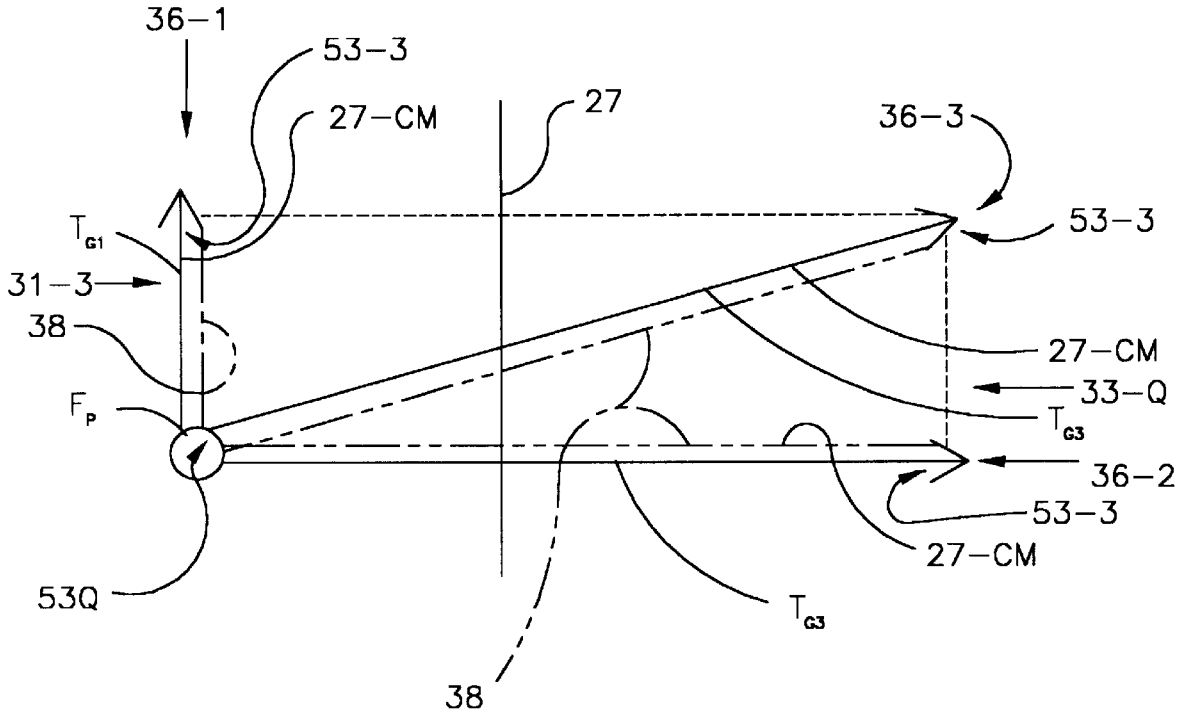

The plurality of structural, gas carrying pipes 27-CM, or the many compression members 38, may be connected in a triangular shape as shown in FIG. 9D (and referred to as a triangular frame 33-T) or in a quadrilateral shape having four sides as shown in FIGS. 9E and 9G (and referred to as a quadrilateral frame 48-Q). In either case, the shape is referred to as the frame 33, the sides of which define a closed perimeter. For aeration units 26 used in a circular basin (not shown), the quadrilateral shape may, for example, be trapezoidal as shown in FIG. 9F, which is referred to as a frame 33-TRAP. For aeration units 26 used in a square or rectangular basin 20, for example, the quadrilateral shape may be square, or rectangular as shown in FIG. 9G, which may also be referred to as a frame 33-R.

A corner 53 of the triangular frame 48-T, or one or more corners 53 of the quadrilateral frame 48-Q, is/are defined by the pipes 27-CM, or by the compression member 38. The force applicator 41 is connected to such corner 53 to apply the primary force $F_P$ to the corner 53. The primary force $F_P$ applied to the corner 53 moves each adjacent compression member 38, or pipe 27-CM, that forms the corner 53. As an example, an embodiment 31-3 has the quadrilateral frame 33-Q shown in FIG. 9G. One corner 53Q is the place at which the primary force $F_P$ is applied. Three modules 36 extend from that corner 53Q. Each module 36 includes one compression member 38 (shown by dash-dot-dot-dash lines) and one force transfer strand 44 (FIG. 5) in the force transfer path T (as shown by the arrows $T_{G1}$, $T_{G2}$, and $T_{G3}$). In the manner described above for the module 36 of embodiment 31-1, each module 36 of embodiment 31-3 of the retrieval apparatus 31 shown in FIG. 9G is effective to either lift up or pull down the respective compression members 38 (or pipes 27-CM) according to the direction (up or down) in which the primary force $F_P$ is applied to the corners 53Q. As shown in FIG. 5 with respect to one compression member 38, the distal ends 43 of the three compression members 38 (i.e., the ends 43 that are away from the common corner 53Q at the proximal end 37) are lifted or pulled down according to the direction of the force $F_P$ applied to the proximal end 37.

Method Of Moving Aeration Units 26

The method of the present invention is shown in FIG. 11 as involving a step 100 of providing the flexible force transfer strand 44 of the module 36. Referring also to FIGS. 12A and 12B, the strand 44 has first and second opposite ends 46 and a total strand length TSL (shown in FIGS. 3, 5 and 8 between the arrowheads of two spaced arrows TSL) that is substantially constant under tension. In step 200 the flexible force transfer strand 44 is placed in the force transfer path T with the opposite ends 46 of the strand 44 fixed against movement. In reference to the module 36 shown in FIG. 3, the force transfer path T extends from a fixed point 56 above one of the ends of the compression member 38 (e.g., the end 43) and around the end 43 and along the compression member 38 to the other (proximal) end 37 of the compression member 38 and around that end 37 and to another fixed point 56 below the proximal end 37. In step 300, the compression member 38 is moved by applying the primary force $F_P$ to the proximal end 37 of the compression member 38. The primary force $F_P$ is sufficient to move the proximal end 37 of the compression member 38. As the proximal end 37 of the compression member 38 moves in the given direction (shown as up in FIG. 3), in step 400 the force transfer strand 44 transfers some of the primary force $F_P$ to the distal end 43 as the transferred force $F_T$, and places the compression member 38 in compression via the transferred force $F_c$, to thereby use the force $F_{L\text{-}U}$ to move the distal end 43 in the given direction (e.g., up in FIG. 3).

Detailed Description of Module 36

Figure 7:
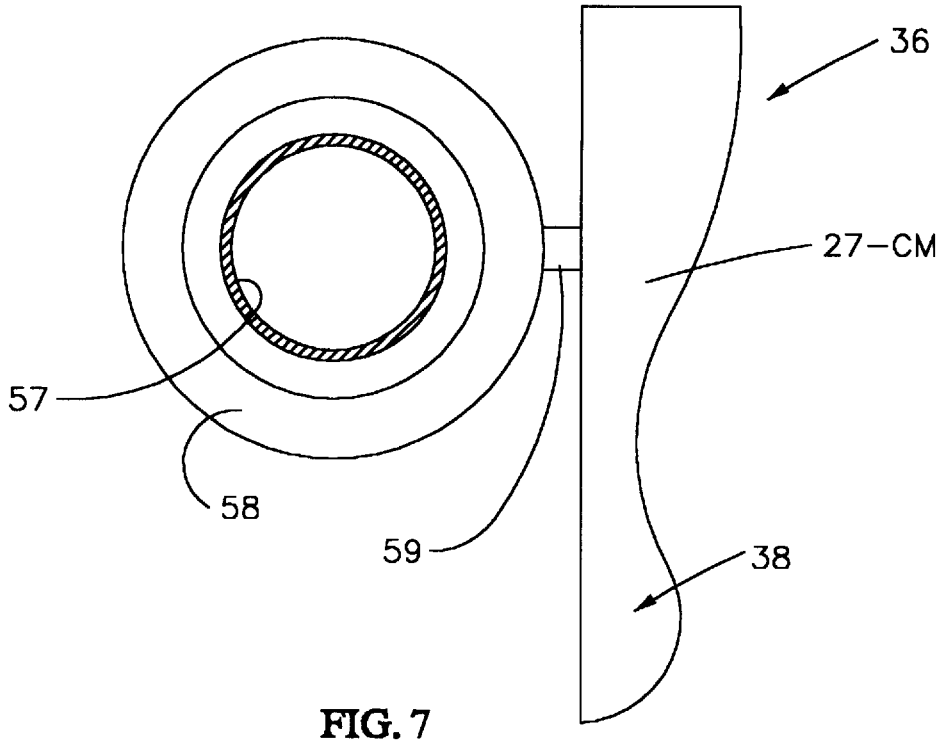
FIG. 7 is a cross sectional view taken along line 7—7 of FIG. 6 showing a ring-shaped guide around the post, the ring being secured to one of the aeration units.
Figure 6:
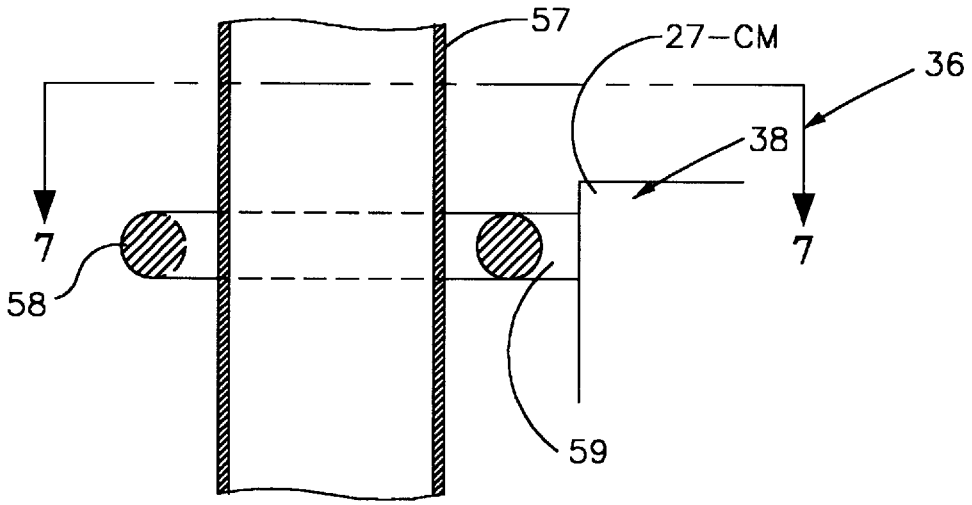
FIG. 6 is an elevational view taken on line 6—6 of FIG. 2, showing one of the posts shown in FIG. 5, illustrating how the post guides the aeration unit.

In greater detail, the module 36 may be used to provide movement in either of two opposite directions. For economy of description, movement upwardly out of the basin 20 is described in connection with FIGS. 3 and 5, and then the reverse movement is briefly explained in connection with FIGS. 5 and 8. The aeration unit 26 shown in FIGS. 1 and 3 has the compression member 38 as one main support. The compression member 38 extends horizontally across the basin 20, and has loads reasonably balanced from side to side along the length of the beam (e.g., along the longitudinal axis 47 shown in FIG. 2). As shown in FIGS. 6 and 7, posts 57 are provided at opposite ends of the compression member 38 a shown in FIGS. 3 and 5 to guide the vertical movement of the compression member 38. A ring surrounds the post 57 and is connected to the compression member 38 by an arm 59.

When the aeration unit 26 is to be moved in the basin 26 for repair, as by moving it up, out of the basin, 26 it is desirable to move the proximal end 37 and the distal end 43 of the compression member 38 generally at the same time. The retrieval apparatus 31 shown in FIGS. 3 and 8 applies an external force in a given direction (e.g. upwardly) only to the proximal end 37, yet both of the ends 37 and 43 move out of the basin 20 generally at the same time. The external force is the primary force $F_P$. The force applicator 40 is provided for applying the (external) primary force $F_P$ to the proximal end 37 of the compression member 38 of the aeration unit 26 to move the proximal end 37 upwardly in the basin 20 in this example. The force applicator 40 is driven by the drive 41, which may be a hydraulic or pneumatic drive, or a motor driven drive, such as a reel. In FIGS. 1, 5 and 8, the drive 41 is shown as a hand operated winch 41. The winch 41 is mounted above the near wall 22 of the basin 20 (the side 39 or left wall 22 in FIG. 3) so that it is near the operator, or near controls (not shown) used by the operator. Whether hand operated or motor driven, the winch 41 takes up and pays out the force applicator 40, which may be a ¼ inch stainless steel wire rope for loads of up to 5000 pounds, or may be two parallel stainless steel bands, each having a two inch width and a ten mil thickness, for example.

Still referring the FIGS. 12A and 12B, the force transfer device 42 is responsive to the movement of the proximal end 37 of the compression member 38 to transfer some of the (external) primary force $F_P$ to the second (distal) end 43 of the compression member 38 to move the distal end 43 as the proximal end 37 moves. The force transfer device 42 includes first and second fasteners 61, such as clips or retainers. A first clip 61-1 is at one of the fixed locations 56 relative to the basin 20, generally vertically aligned with the proximal end 37 of the compression member 38 and on one side 62 (e.g., the low side) of the compression member 38, opposite to the other side 63 (e.g., the high side) which is the side to which the drive 41 applies the (external) primary force $F_P$ to the compression member 38. The second clip 61-2 is at the other fixed location 56 relative to the basin 20, generally aligned with the distal end 43 of the compression member 38 and on the other side 63 (the high side) of the compression member 38. A guide 66, such as a roller or pulley, is provided at each of the proximal end 37 (guide 66-P) and distal end 43 (guide 66-D) of the compression member 38, as in a slot 67.

The force transfer device 42 also includes the elongated flexible force transfer strand 44 having the opposite ends 46 connected to respective ones of the first and second fixed clips 61-1 and 61-2 and extending over the guides 66-P and 6-D in the force transfer path T. Such strand may be a chain, a wire rope, or a band. For example, one of the above-described stainless steel bands may be used. The total strand length TSL is substantially constant under tension in the force transfer path T. With the primary force $F_P$ supporting the proximal end 37 of the compression member 38 as such force $F_P$ starts to move the end 37, the lower end 46 of the force transfer strand 44 is fixed (secured to the clip 61-1) and the strand 44 extends along a to variable-length section L-1 to and around the pulley 64-P. The remainder of the TSL of the strand 44 is a constant-length section L-2 and a variable-length section L-3. The distal end 43 is suspended on the sections L-2 and L-3 of the strand 44. As described above, the vertical component $F_{L\text{-}U}$ of the transferred force $F_T$ that the strand 44 transfers to the distal end 43 of the compression member 38 lifts the distal end 43 as the drive 41 lifts the proximal end 37. As this lifting occurs, the variable-length L-1 increases. Because the length L-2 is constant, the length L-3 must decrease, and the decrease occurs via the described lifting of the distal end 43.

Figure 10:
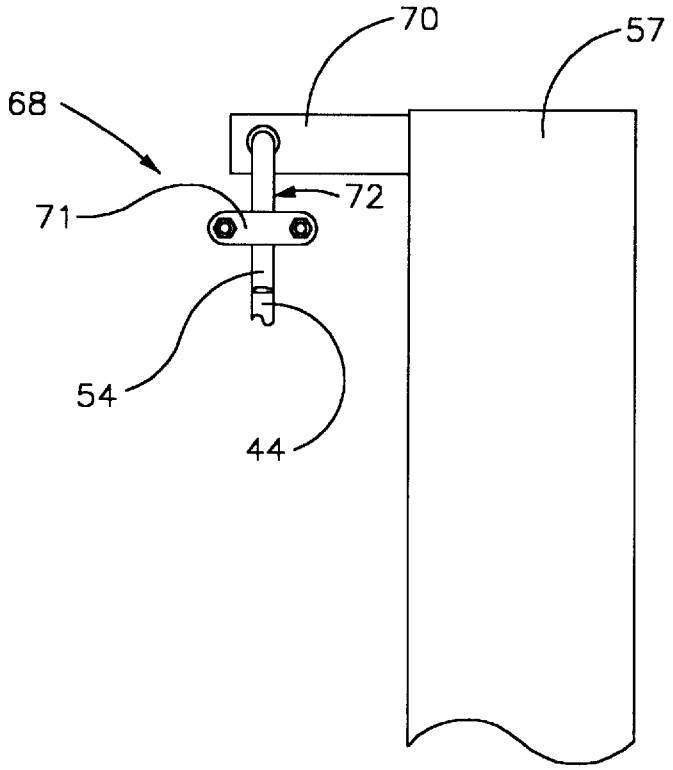
FIG. 10 is an elevational view of a clamp which is used to adjust the operating length of the force transfer strand to level the aeration unit.

The fixed point 56 of the strand 44 is fixed during retrieval of the aeration unit 26. However, an adjuster 68 is provided for adjusting the TSL length of the strand 44 between brackets 70 which are fixed to the posts 57 instead of the clips 61. Referring to FIG. 10, the adjuster 68 is shown including a clamp 71 for holding a loop 72 of the strand 44. The end 54 of the strand 44 extends through a hole in the bracket 70. Adjustment of the clamp 71 permits lengthening or shortening of the TSL length of the strand 44. With the force applicator 40 held fixed by the drive 41, adjustment of the clamp 71 and such lengthening or shortening enables the compression member 38 to be leveled to facilitate even flow of gas from the pipes 27 or 27-CM.

Moving Aeration Unit 26 Into Basin 20

Some liquid treatment units 26 are buoyant and have to be pulled into the liquid 21 for aeration operation. The retrieval apparatus 31 may also be used to move the compression member 38 downwardly into the basin 20 against the buoyant force. Referring to FIG. 8, it may be understood that the same retrieval apparatus 31 may be used to move the compression member 38 downwardly into the basin 20 against the buoyant force. Also, in FIG. 5, a dual direction version of the drive 41 may be used to move the compression member 38 downwardly into the basin 20 against the buoyant force, or upwardly as described with respect to FIG. 3. The direction of the force $F_P$ applied to the proximal end 37 is reversed by extending the applicator 40 around a pulley 73 secured to the bottom 24 of the basin 20. The pulley 73 reverses the direction in which the force transfer strand 44 applies the primary force $F_P$ to the proximal end 37. Also, the end 46A of the strand 44D on the drive side (left side 39 in FIG. 8) is secured out of the liquid 21 at the fixed point 56A, whereas the end 46B of the strand 44 opposite to the drive side (right in FIG. 8) is secured at the fixed point 56B in the liquid 21 near the bottom 24. Based on the description above, the operation of pulling the aeration unit 26 down into the basin 20 may be understood.

Retrieval Apparatus 31 For Section 26A of Aeration Unit 26 Posts 57

As described above, retrieval apparatus 31 of the present invention may be used with an aeration unit 26 which is divided into many separate sections, e.g., 26A, 26B, etc. as shown in FIG. 2. The retrieval apparatus 31 has one section 31A, 32B, etc. for each such section 26A, 26B, etc. of the aeration unit 26. The retrieval apparatus 31A, etc. for the respective sections 26A, etc. of the sectionalized aeration units 26A, 26B, etc., is virtually the same as that described above in connection with FIGS. 1 and 3. As shown in FIGS. 2 and 5, one of the posts 57 is mounted on the bottom 24 of the basin 20 and extends upwardly out of the basin 20. The posts 57 are hollow cylinders, for example. The posts 57 guide the rings 58 for the same vertical movement of the compression members 38 of the retrieval apparatus 31A, 31B, etc. as the posts 57 guide the rings 57 for vertical movement of the compression members 38 of the retrieval apparatus 31 shown in FIGS. 1 and 3. The posts 57 mount the clips 61-2A and 61-2B at the fixed point 56 out of the liquid 21 as shown in FIG. 5. The drive 41 shown in FIG. 5 may be the shared reel drive which is described in application Ser. No. 08/443,819, filed May 18, 1995, now U.S. Pat. No. 5,655,727, entitled Sludge Collector Method and Drive With Shared Reel For Taking Up and Paying Out Cables, of which Applicant C. L. Meurer is a co-inventor, and which is incorporated herein by this reference. That drive 41 drives the force applicator 40 in opposite directions according to the direction in which the winch is rotated. During the force transfer operation of the strand 44, the force $F_P$ may thus have either direction shown in FIG. 5. In each case, the force $F_c$ (FIGS. 12A and 12B) is counteracted by the compression member 38 which resists the compressive force $F_P$. Further, the frames 33 laterally stabilize the posts 57 during the removal and return operations.

Moving The Various Frames 48 Triangular Frame 48-T

As described above, the modules 36, with the plurality of structural, gas-carrying pipes 27-CM, or the many compression members 38, may be connected to form the triangular frame 33-T shown in FIG. 9D. Based on the description of the modules 36, it may be understood from FIG. 9D that two modules 36 are used in an embodiment 31-4 of the retrieval apparatus 31 shown in FIG. 9D. The corner 53 is between the two modules 36. The primary force $F_P$ applied to the corner 53 moves each adjacent compression member 38, or pipe 27-CM, that forms the corner 53. Two force transfer paths $T_{D1}$ and $T_{D2}$ transfer the primary force $F_P$ to the distal ends 43 of each of the compression members 38 (or pipes 27-CM), and the distal ends 43 move as described above with respect to FIGS. 3 and 9A.

Variation of U-Shaped Frame 48-U

A variation of the embodiment 31-2 of the retrieval apparatus 31 is shown as an embodiment 31-5 in FIG. 9B, and also provides the U-shaped frame 33-U. Such frame 33-U has the compression members 38 (or the pipes 27-CM) parallel and a center pipe 27-CM between the two compression members 38 (or the pipes 27-CM). The drive 41 applies the primary force $F_P$ to a midpoint 81 of the center pipe 27-CM. The center pipe 27-CM transfers the primary force $F_P$ to the respective ends 51 of the center pipe 27-CM. The ends 51 are connected directly to each proximal end 37 of the compression members 38 that are connected to the center pipe 27-CM. The operation of the embodiment 31-5 of the retrieval apparatus 31 is thereafter the same as the operation of the embodiment 31-2 of the retrieval apparatus 31 as described above with respect to FIG. 9C.

Quadrilateral Frame 48-Q

The quadrilateral frame 33-Q has four sides as shown in FIGS. 9E and 9G. In either case, the perimeter of the frame 48-Q is closed. The difference between the quadrilateral frame 48-Q of an embodiment 31-6 (FIG. 9E) of the retrieval apparatus 31, and the U-shaped frames 49-U of embodiments 31-2 and 31-5, is that in embodiment 31-6 (FIG. 9E) a pipe 27 is provided between the opposite distal ends 43 of the compression members 38, whereas no such pipe 27 is provided in the U-shaped frames 33-U shown in FIGS. 9B or 9C. Thus, the operation of embodiment 31-6 (FIG. 9E) may be understood from the above description of FIG. 9C (embodiment 31-2).

Another version of the quadrilateral frame 33-Q is shown in FIG. 9F as embodiment 31-7 for a circular basin 20 (not shown). The circular basin 20 has circular outer walls 22, such that the aeration apparatus 26 is in sections 26A, 26B, etc. Each section 26A, etc. has the trapezoidal frame 33-TRAP shown in FIG. 9F, so that multiple frames 33-TRAP combine to position the pipes 27, or the pipes 27-CM, to aerate all of the area of the circular basin. The sections 26A, etc. having the trapezoidal frames 33-TRAP are the same as the other quadrilateral frames 33-Q in that the perimeter of the frame 33-TRAP is closed. The difference between the quadrilateral frame 33-Q of embodiment 31-6 (FIG. 9E) and the trapezoidal frames 33-TRAP of embodiments 31-7 is that in embodiment 31-7 (FIG. 9F) the pipe 27 on the right side of the frame 33-TRAP is longer than the corresponding pipe 27 of embodiment 31-6 (FIG. 9E). The operation of embodiment 31-7 (FIG. 9F) may be understood from the above description of FIGS. 9C (embodiment 31-2) and 9E.

In embodiment 31-3 (FIG. 9G), the quadrilateral frame 48-Q has the corner 53Q defined between one module 36-1 and a second module 36-2 at right angles to the module 31-1. Also, a third module 31-3 extends diagonally across from the corner 53Q to a corner 53-3. Preferably, the diagonal of the third module 36-3 includes a compression member 38. Based on the description of the one module 36 above in re FIG. 9A, it may be understood that in embodiment 31-3 one third of the primary force $F_P$ is transferred from the corner 53Q into each of the three modules 36-1, 36-2 and 36-3, to the respective corners 53-1, 53-2 and 53-3. Each such corner 53-1, 53-2, and 53-3 is moved as the primary force $F_P$ moves the proximal end 37 of each such module 36-1, 36-2, and 36-3.

The foregoing description of the present invention illustrates and describes the invention and is not intended to limit the invention to the form disclosed herein. The embodiments disclosed are intended to describe the best modes known of practicing the invention and to enable others skilled in the art to use such invention in such or other embodiments. It is intended that the appended claims be interpreted so as to include alternative embodiments to the extent permitted by the prior art.

What is claimed is:

1. Apparatus for moving first and second ends of an aeration unit generally at the same time by applying an external force in a given direction only to one of said ends; said apparatus comprising:

a drive for applying the external force to said first end of said unit to move said first end; and a device responsive to said movement of said first end of said unit to place the unit in compression and transfer some of the external force to said second end of said unit to move said second end as said first end moves.

2. Apparatus according to claim 1, further comprising:

said device comprising a flexible tension member having a fixed length divided into three sections, a first one of said sections extending in a first direction opposite to the given direction and around said first end and being of variable length, a second one of said sections extending in a third direction parallel to said given direction and opposite to said first direction and being of variable length, and a third one of said sections extending along said unit between said first and second sections and being of fixed length.

3. Apparatus according to claim 2, further comprising:

in response to said movement of said first end, said variable length of said first section varying oppositely to said variable length of said second section so that as said first end moves, the length of said first section increases and the length of said second section decreases.

4. Apparatus according to claim 3, wherein said ends of said unit have opposite first and second sides, and the external force is applied to said first side of said unit, further comprising:

said tension member having a first end adjacent to said first section and a second end adjacent to said second section;

said device further comprising first and second retainers respectively attached to said first and second ends of said tension member, said first retainer being adjacent to said second side and said second retainer being adjacent to said first side.

5. Apparatus according to claim 1, further comprising:

said device comprising a guide at each of said first and second ends, and a flexible tension member extending in a force transfer path around said guides to transfer the external force to said second end.

6. Apparatus according to claim 5, further comprising:

said flexible tension member having opposite ends fixed against movement when the external force is applied to said first end.

7. Apparatus for lifting or lowering first, second, third and fourth ends of an aeration unit generally at the same time by applying an external force in a given vertical direction only to one of said ends; said first and second ends being connected, said third end being opposite to said first end, said fourth end being opposite to said second end, said apparatus comprising:

a first compression member having said first and third ends;

a second compression member having said second and fourth ends;

a drive for applying the external force to said connected first and second ends of said unit to move said first and second ends of said respective first and second members;

a first device responsive to said movement of said first end to place said first member in compression and transfer some of the external force to said third end to move said third end as said first end moves; and a second device responsive to said movement of said second end to place said second member in compression and transfer some of the external force to said fourth end to move said fourth end as said second end moves.

8. Apparatus for lifting or lowering first, second, third and fourth corners of an aeration unit generally at the same time by applying external force in a given vertical direction only to two of said corners; said corners being connected to form a quadrilateral frame, said apparatus comprising:

a plurality of compression members, a first of said compression members having a first end at a first of said corners and extending to a third of said corners, a second of said compression members having a second end at a second of said corners and extending to a fourth of said corners;

a first drive for applying a first external force to said first corner to move said first end of said first member;

a first device responsive to said movement of said first end to place said first member in compression and transfer some of the first external force to said third corner to move said third corner as said first end moves;

a second drive for applying a second external force to said second corner to move said second end of said second member; and a second device responsive to said movement of said second end to place said second member in compression and transfer some of the second external force to said fourth corner to move said fourth corner as said second end moves.

9. Apparatus for lifting or lowering first, second, third and fourth corners of an aeration unit generally at the same time by applying external force in a given vertical direction only to one of said corners; said corners being connected to form a quadrilateral frame, said apparatus comprising:

a plurality of compression members, a first of said compression members being between a first of said corners and a second of said corners, a second of said compression members being between said first of said corners and a third of said corners, a third of said compression members being between said first of said corners and a fourth of said corners;

a drive for applying the external force to said first corner to move said first corner;

a first device responsive to said movement of said first corner to place said first member in compression and transfer some of the external force to said second corner to move said second corner as said first corner moves;

a second device responsive to said movement of said first corner to place said second member in compression and transfer some of the external force to said third corner to move said third corner as said first corner moves; and a third device responsive to said movement of said first corner to place said third member in compression and transfer some of the external force to said fourth corner to move said fourth corner as said first corner moves.

10. Apparatus for lifting or lowering an elongated member having two opposite, first and second ends and opposite sides; the movement being relative to a basin of a liquid treatment facility; said apparatus comprising:

first and second clips, said first clip being at a fixed location relative to said basin on one of said sides of said member; said second clip being at a fixed location relative to said basin on the other of said sides of said member;

a guide at each of said first and second ends of said member;

a force applicator for moving said first end of said member relative to said basin in a first direction; and an elongated flexible force transfer strand connected to each of said first and second clips and extending over said guides so that as said applicator moves said first end relative to said basin of said liquid treatment facility, said guide at said first end forces said strand against said guide at said second end to move said second end of said member relative to said basin of said liquid treatment facility in the first direction.

11. Apparatus according to claim 10, further comprising:

said guides being pulleys mounted for rotation on said ends of said elongated member.

12. Apparatus according to claim 10, further comprising:

said guides comprising curve rollers mounted for rotation on said elongated member;

said elongated flexible force transfer strand extending over said rollers so that as said applicator moves said first end relative to said basin said roller at said first end forces said strand to move around said roller at said first end and said strand transfers force to said roller at said second end to move said second end with said first end in the first direction.

13. Apparatus for lifting or lowering a water treatment device relative to a basin having first and second opposite sides; said device including a support member having a first end adjacent to said first side of said basin, said support member having a dimension extending across said basin toward said second side to a second end; said basin having a support provided with a top at a height equal to about an upper position to which said device may be moved relative to said basin; said first side having a bottom at a depth equal to about a lower position to which said device may be moved relative to said basin; said apparatus comprising:

a flexible tension member having total length equal to the length of the dimension of said support member plus the vertical length from said top to said bottom of said basin, said total length being between a first terminus of said tension member and a second terminus of said tension member;

a first catch at said bottom secured to said first terminus of said tension member;

a second catch at said top secured to said second terminus of said tension member;

a first guide at said first end of said support member;

a second guide at said second end of said support member;

said tension member extending from said first terminus secured to said first catch along a first distance around said first guide, then from said first guide to said second guide, and then around said second guide along a second distance to said second terminus secured to said second catch, said first distance being less than said second distance when said support member is adjacent to said bottom; and a drive for moving said first end of said support member away from said first catch to increase the first distance and decrease the second distance and thereby render said tension member effective to move said second end of said support member toward said second catch as said first end of said support member moves away from said first catch.

14. Apparatus according to claim 13, further comprising:

said first and second guides each comprising a pulley rotatably mounted on said support member for guiding said tension member; and said tension member comprising a cable having a substantially fixed length under tension, said tension member extending around said second pulley and supporting and moving said second end of said support member as said first end moves away from said first catch.

15. A force transfer apparatus for moving opposite first and second ends of a water treatment unit into a water treatment basin at the same time in response to a downward external force applied to only said first end of said unit, said basin having a second fixed point in said basin below said second end of said unit and a first fixed point in said basin above said first end of said unit; said apparatus comprising:

a drive for applying the downward external force to said first end of said unit to move said first end into said basin;

a first guide mounted on said first end for movement with said first end;

a second guide mounted on said second end for movement with said second end; and a first tension member secured to and extending from said first fixed point and around said first guide and along said unit to said second end of said unit and around said second guide and into said basin to and secured to said second fixed point.

16. Apparatus according to claim 15, wherein said apparatus also moves said opposite first and second ends of said water treatment unit out of said water treatment basin at the same time in response to external upward force applied to only said first end of said unit, said basin having a third fixed point in said basin below said first end of said unit and a fourth fixed point secured to said basin above said second end of said unit; further comprising:

said drive also applying the upward external force to said first end of said unit to move said first end out of said basin;

a third guide mounted on said first end for movement with said first end;

a fourth guide mounted on said second end for movement with said second end;

a second tension member secured to and extending from said third fixed point and around said third guide and along said unit to said second end of said unit and around said fourth guide and out of said basin to and secured to said fourth fixed point.

17. Apparatus for lifting or lowering opposite first and second ends of a compression member simultaneously from a first location toward a second location, said apparatus comprising:

a first pulley rotatably mounted on said first end;

a second pulley rotatably mounted on said second end;

a first retainer fixed at said first location aligned with said first end;

a second retainer fixed at said second location aligned with said second end;

a tension cable secured to said first retainer and extending around said first pulley and then around said second pulley and then extending to and secured to said second retainer; and a drive for moving said first end from said first location to said second location.

18. Apparatus for lifting or lowering a frame relative to a liquid basin, said frame having opposite sides and opposite ends which form a parallelogram, said frame having two pairs of diagonally opposite corners, one of said pairs of corners having first and second corners, a second of said pair of corners having third and fourth corners; said apparatus comprising:

a first pair of guides, one guide of said first pair of guides being at a respective one of said first and second corners;

a second pair of guides, one guide of said second pair of guides being at a respective one of said third and fourth corners;

a first tension member secured to said basin below said first corner and extending around said guide at said first corner and extending diagonally across said frame to and around said guide at said second corner and to and secured to said basin above said second corner;

a second tension member secured to said basin below said third corner and extending around said guide at said third corner and extending diagonally across said frame to and around said guide at said fourth corner and to and secured to said basin above said fourth corner; and a drive for moving said first corner of said frame relative to said basin.

19. Apparatus for lifting or lowering a frame relative to a liquid basin, said frame having opposite sides and opposite ends which form a parallelogram, said frame having at least three pairs of corners, one of said pairs of corners having first and second corners, a second of said pair of corners having said second corner and a third corner, and a third of said pair of corners having said third corner and a fourth corner; said apparatus comprising:

a first pair of guides, one guide of said first pair of guides being at a respective one of said first and second corners;

a second pair of guides, one guide of said second pair of guides being at a respective one of said second and third corners;

a third pair of guides, one guide of said third pair of guides being at a respective one of said third and fourth corners;

a first tension member fixed below said first corner and extending around said guide at said first corner and extending across said frame to and around said guide at said second corner and to and secured to said basin above said second corner;

a second tension member fixed below said second corner and extending around said guide at said second corner and extending across said frame to and around said guide at said third corner and to and secured to said basin above said third corner;

a third tension member fixed below said third corner and extending around said guide at said third corner and extending across said frame to and around said guide at said fourth corner and to a fixed point above said fourth corner; and a drive for moving said first corner of said frame relative to said basin.

20. A device for lifting or lowering a unit in a water treatment basin from a first position to a second position, said unit having a first end and a second end and a first side and a second side, said device comprising:

a first support adjacent to said one end and positioned relative to said unit toward said second position;

a second support adjacent to said second end and positioned relative to said unit toward said first position;

a first pulley rotatably mounted on said unit adjacent to said first end;

a second pulley rotatably mounted on said unit adjacent to said second end;

a tension member extending from said first support, around said second pulley, around said first pulley, and secured to said second support; and a drive for applying force to said first end to move said first end from said first position toward said second position.

* * * * *